US005228500A

United States Patent [19]

Sano

[11] Patent Number: 5,228,500

[45] Date of Patent: Jul. 20, 1993

[54] AIR CONDITIONING SYSTEM

[75] Inventor: Tetsuo Sano, Kanagawa, Japan

[73] Assignee: Kabushiki Kaisha Toshiba, Kanagawa, Japan

[21] Appl. No.: 672,016

[22] Filed: Mar. 19, 1991

[30] Foreign Application Priority Data

Mar. 28, 1990 [JP] Japan ..... 2-76615

[51] Int. Cl.[5] ..... F24F 5/00

[52] U.S. Cl. ..... 165/49; 165/57; 165/904; 62/DIG. 1

[58] Field of Search ..... 62/272, DIG. 1, 275; 237/69; 165/49, 57, 904, 133; 126/901

[56] References Cited

U.S. PATENT DOCUMENTS

| | | | |
|---|---|---|---|
| 2,245,470 | 6/1941 | Fuchs | 237/69 X |
| 2,392,240 | 1/1946 | Frankel | 62/DIG. 1 |
| 2,533,407 | 12/1950 | Skillman | 165/57 X |
| 2,966,780 | 1/1961 | Mills | 62/DIG. 1 |
| 3,097,650 | 7/1963 | Mills | 62/DIG. 1 |
| 3,453,413 | 7/1969 | Reynolds, Jr. | 165/49 X |
| 3,905,203 | 9/1975 | Jacob | 62/272 |
| 3,968,660 | 7/1976 | Amann et al. | 62/275 |
| 4,005,698 | 2/1977 | Cuomo et al. | 126/901 X |
| 4,026,271 | 5/1977 | Schmidt | 126/901 X |
| 4,198,222 | 4/1980 | Wood | 62/272 |

FOREIGN PATENT DOCUMENTS

| | | | |
|---|---|---|---|
| 58-12934 | 1/1983 | Japan | 165/57 |
| 1-6630 | 1/1989 | Japan | 165/57 |

*Primary Examiner*—Allen J. Flanigan

*Attorney, Agent, or Firm*—Banner, Birch, McKie & Beckett

[57] ABSTRACT

An air conditioning system in accordance with the present invention is disclosed which has a radiation plate including a radiation surface facing a room area. A column of air that is either cooled or heated by a heat exchanger in an indoor unit of the present air conditioning system, is directed to flow along the radiation surface of the radiation plate. The room area is then either cooled or heated by radiant energy using the radiation properties of the radiation surface.

19 Claims, 15 Drawing Sheets

AIR CONDITIONING SYSTEM

BACKGROUND OF THE INVENTION

1. Field of the Invention

The present invention generally relates to an air conditioning system, such as for use in cooling and heating rooms or similar compartments, and more particularly, to an air conditioning system which heats and cools by radiation. Air conditioning system, as used herein, refers to a system that both cools and heats rooms. Such a system may include what is commonly known as a heat pump type of air conditioning system.

2. Description of the Prior Art

Generally, a conventional air conditioning system used in a house or similar dwelling cools the rooms in the house or dwelling in a cooling mode of operation, by supplying a forced flow of cooled air from an indoor unit of the system. However, such a forced air cooling operation often supplies uncomfortable drafts of cool air to the people in the rooms. In contrast, some conventional air conditioning systems may be structured to heat rooms by radiation (i.e., radiant energy heating) to prevent supplying uncomfortable drafts of heated air into the rooms. For example, an air conditioning system may be adapted for radiant energy heating, whereby a radiation surface is formed under or on the surface of a floor, and pipes that circulate high temperature refrigerant from a compressor operating during a heating cycle are arranged on the radiation surface. Conversely, cooling of air in these rooms may also be accomplished by radiation (i.e., radiation cooling) by reversing the flow of refrigerant in such an air conditioning system, whereby the pipes arranged on the radiation surface circulate cooled refrigerant during a cooling mode of operation.

Nevertheless, conventional air conditioning systems experience a significant problem if radiation cooling is attempted utilizing a similar structure to that used for radiant energy heating. That is, since the radiation surface is heat exchanged directly by the cooled refrigerant, the humid air surrounding the radiation surface is condensed into dew or droplets of water onto the radiation surface. This water can freeze on the surface and substantially reduce the cooling efficiency of the system. Consequently, even if a conventional air conditioning system may be capable of heating rooms by radiation during a heating mode, such a system is still required to cool the rooms by blowing cool air into the rooms during the cooling mode of operation.

SUMMARY OF THE INVENTION

Accordingly, it is a primary object of the present invention to provide an improved air conditioning system with a structure that can cool rooms by radiation.

It is also an object of the present invention to provide an improved air conditioning system with a structure that can both heat and cool rooms by radiation.

It is yet another object of the present invention to provide an improved air conditioning system with a structure that can cool rooms by radiation and increase the cooling efficiency of the system.

An air conditioning system according to the present invention comprises an indoor unit and an outdoor unit, whereby the indoor unit further comprises a radiation member including a radiation surface facing a room area and a cool air supply means for directing a flow of cool air along the radiation surface of the radiation member.

An air conditioning system according to another aspect of the present invention comprises an indoor unit and an outdoor unit, whereby the indoor unit comprises a radiation member including a radiation surface facing a room area and a warm air supply means for directing a flow of warm air along the radiation surface of the radiation member.

BRIEF DESCRIPTION OF THE DRAWINGS

A more complete appreciation of the present invention and many of the attendant advantages thereof will be readily obtained by as the invention becomes better understood by reference to the following detailed description when considered in connection with the accompanying drawings.

DETAILED DESCRIPTION OF THE PREFERRED EMBODIMENTS

Figure 1:
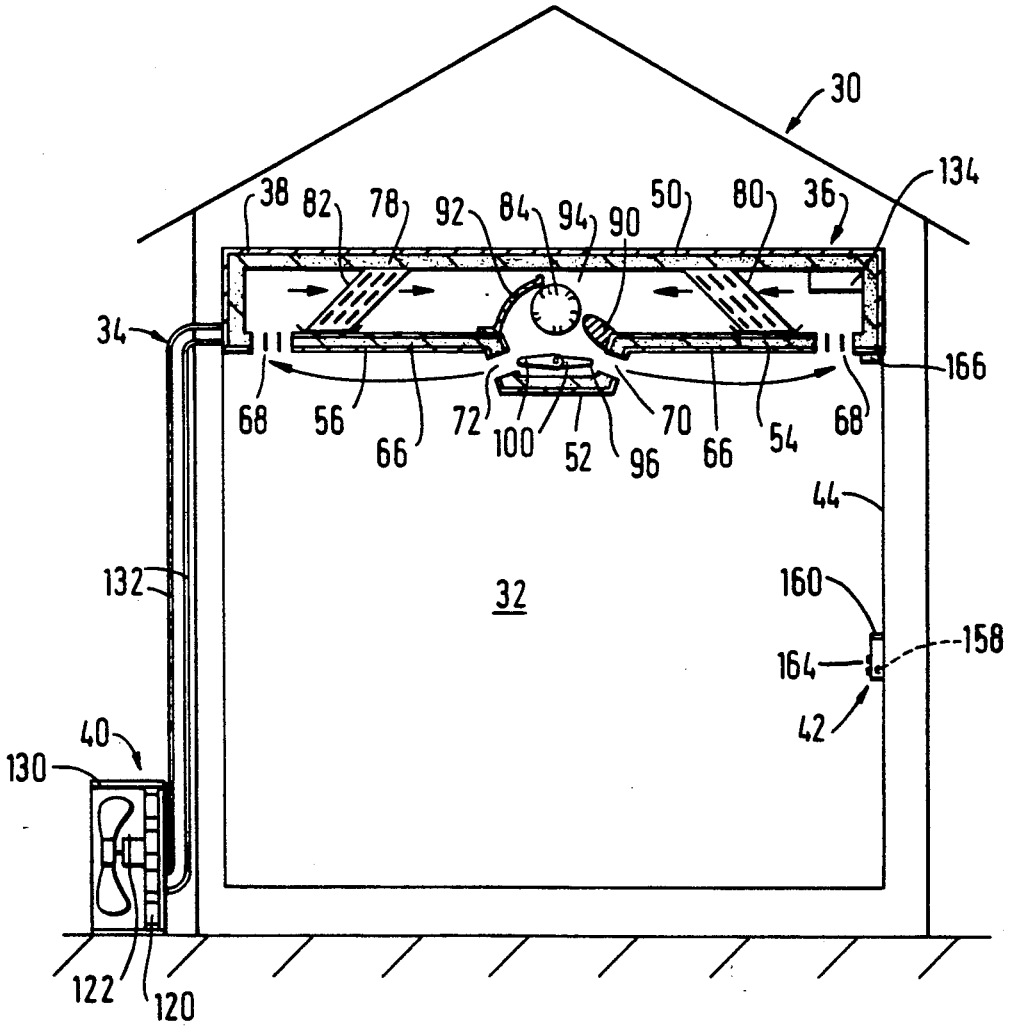
FIG. 1 is a cross sectional view of a house and an air conditioning system in accordance with a preferred embodiment of the present invention.

As noted above, air conditioning system as used herein, refers to a system that both cools and heats the air in a room or similar compartment. FIG. 1 is a cross sectional view of a house and an air conditioning system in accordance with a preferred embodiment of the present invention.

Conventional house 30 includes room 32 which serves as a residential area therein. Air conditioning apparatus 34 includes indoor unit 36 installed on ceiling 38 of room 32 and outdoor unit 40 installed outside of house 30. Remote controller 42 is attached to wall 44 of room 32.

Figure 2:
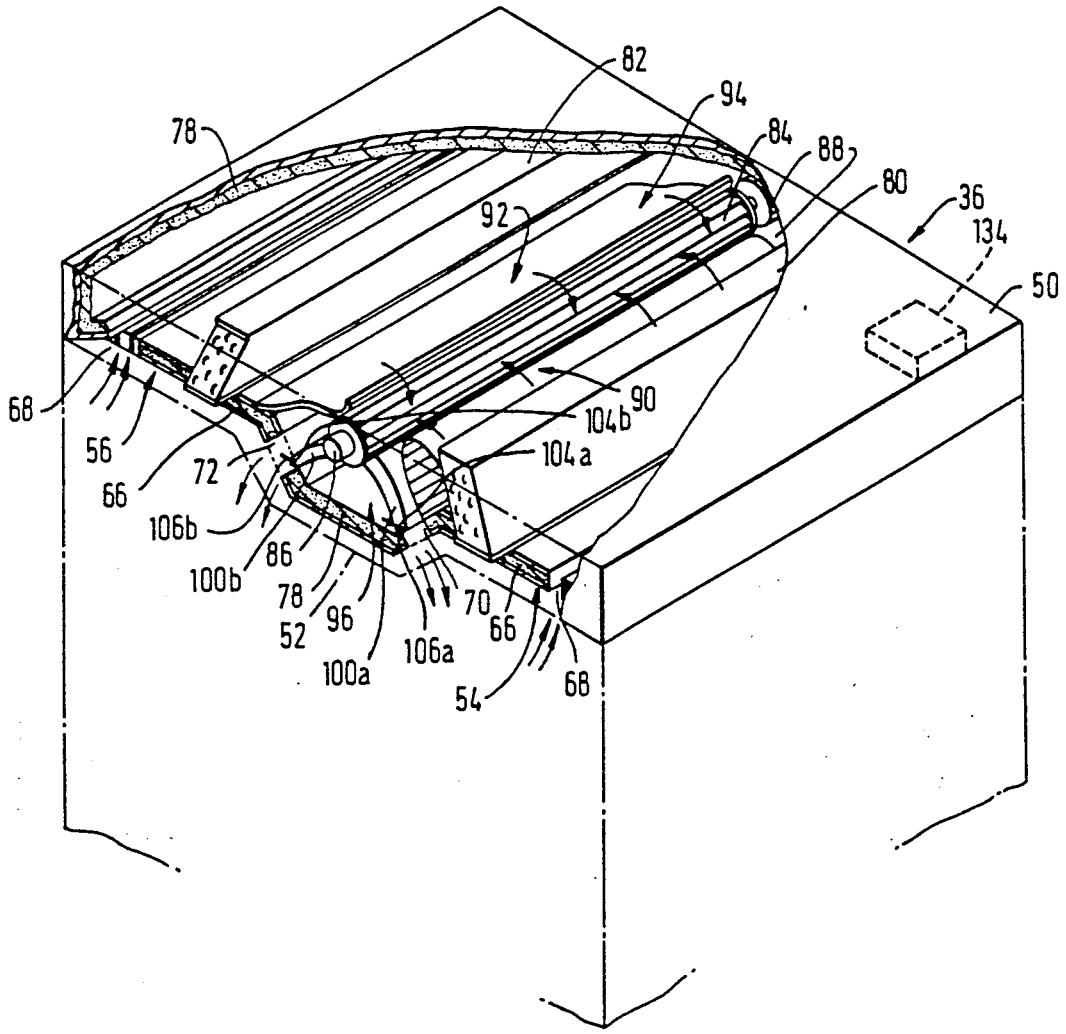
FIG. 2 is a partially cutaway perspective view of an indoor unit of the air conditioning system shown in FIG. 1.
Figure 3:
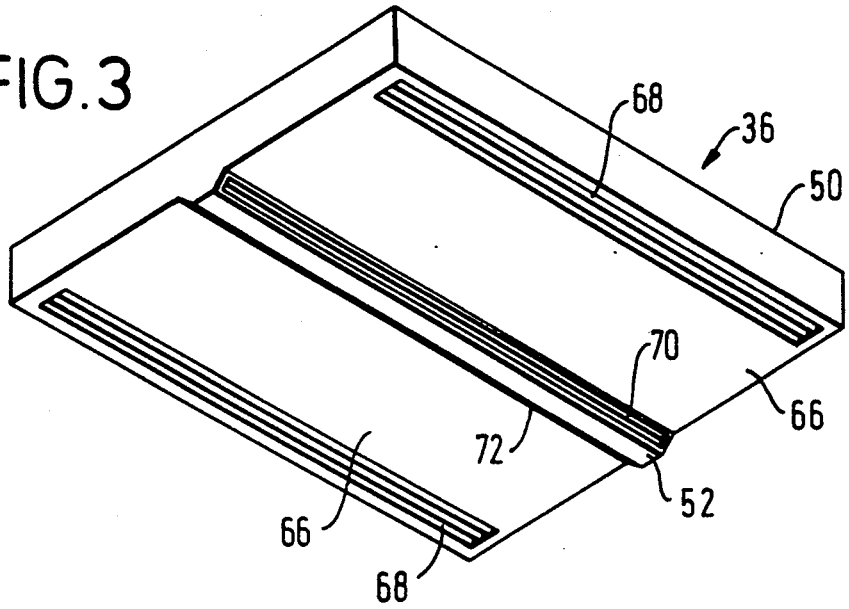
FIG. 3 is a perspective view of a radiation surface of the indoor unit shown in FIG. 2.
Figure 4:
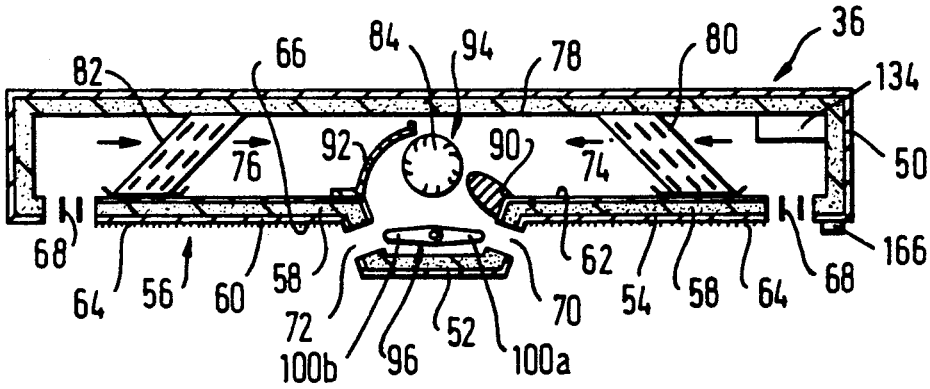
FIG. 4 is a cross sectional view of the indoor unit shown in FIGS. 1 and 2.
Figure 5:
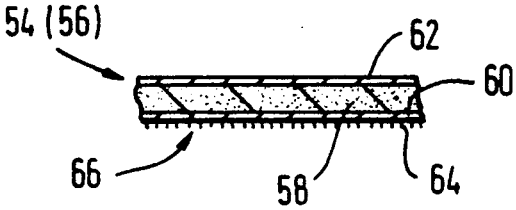
FIG. 5 is a cross sectional view of the radiation plate shown in FIGS. 1 and 2.

The details of indoor unit 36 are disclosed with reference to FIGS. 2 through 5. FIG. 2 is a partially cutaway perspective view of indoor unit 36. FIG. 3 is a perspective view of a radiation surface of indoor unit 36. FIGS. 4 and 5 are cross sectional views of indoor unit 36 and a radiation plate of indoor unit 36, respectively.

Container 50 of indoor unit 36 is shaped like a flat box which is sized to cover the entire surface of ceiling 38. The upper wall of container 50 is fixedly attached to ceiling 38 (see FIG. 1). The lower wall of container 50 includes projection portion 52 and plates 54 and 56. Long projection portion 52 is positioned in the near center portion of the lower wall of container 50 (see FIG. 3). Plates 54 and 56 each have a material attached which resists the formation of dew or condensed water droplets, and which also has high water absorption and retention properties. That is, as shown in FIGS. 4 and 5, plate 54 (or plate 56) includes plate-shaped foam urethane portion 58, plastic plates 60 and 62 that sandwich plate-shaped foam urethane portion 58, and a group of hair-like projections 64 implanted onto the surface of plastic plate 60 and facing the room area. The nature of the combination of foam urethane portion 58 and plastic plates 60 and 62 provides a low heat conduction property. Consequently, dew or water condensation does not form easily, even with uneven cooling. In the event dew or water condensation occurs, the moisture is retained or absorbed by the group of implanted hair-like projections 64. The material used for each of the implanted hair-like projections 64 may be, for example, a fiber.

Radiation surface 66 of plate 54 (and 56) is formed by implanting the complete surface of plastic plate 60 facing the room area with the group of hair-like projections 64.

Plates 54 and 56 each include band-shaped inlet portions 68 disposed beside a respective wall 44 of room 32 and running parallel to projection portion 52. Band-shaped nozzles 70 and 72 are formed by the areas defined between respective plates 54 and 56 and projection portion 52, and running parallel to inlet portions 68. Thus, symmetrical air circulation routes 74 and 76 are defined within container 50 from inlet portions 68 toward nozzles 70 and 72. Additionally, stratified heat insulating material 78 is fixedly attached to the complete inner surface of container 50, except for the inner surfaces of plates 54 and 56.

Indoor heat exchangers 80 and 82 are arranged diagonally from the sides of, and running parallel to, inlet portions 68 in the path of circulation routes 74 and 76.

Above projection portion 52 and inside container 50, a long, cross flow fan 84 is arranged in parallel with projection portion 52. One of the ends of cross flow fan 84 is rotatably supported by bearing 86 fixedly attached to a side wall of container 50. The other end of cross flow fan 84 is connected directly to the output axis of fan motor 88 (motor not shown) fixedly attached to the opposite side wall of container 50 (see FIG. 2). Narrowing members 90 and 92 project toward the inlet side of cross flow fan 84 from the ends of respective plates 54 and 56 nearest projection portion 52. Cross flow fan 84 and wringing members 90 and 92 form room fan 94 (i.e., a ventilation fan). That is, room fan 94 pulls in air from inlet portions 68 of container 50 and directs the air to nozzles 70 and 72 according to the operation of fan motor 88.

Figure 6:
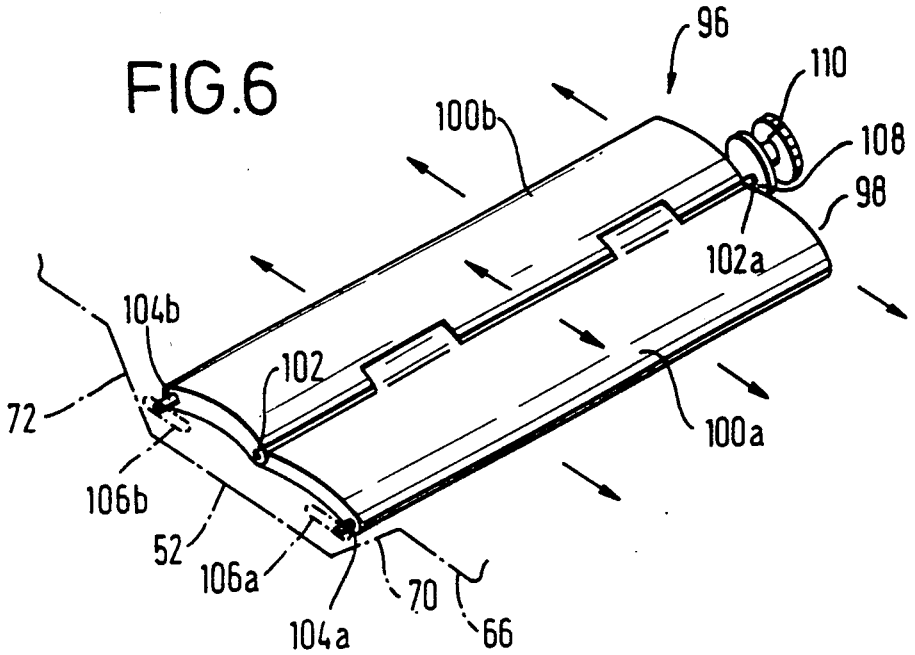
FIGS. 6 and 7 are perspective views of the louver mechanism shown in FIG. 2.
Figure 7:
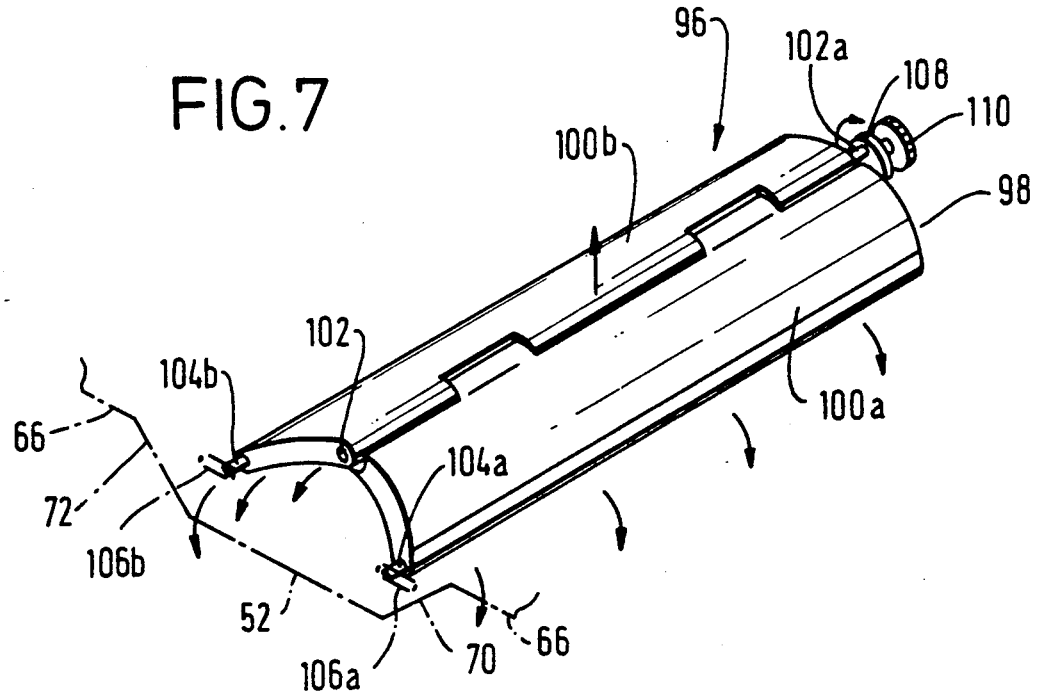

Louver mechanism 96 is arranged within the area defined by projection portion 52. FIGS. 6 and 7 show perspective views of louver mechanism 96. Referring to FIGS. 6 and 7, louver mechanism 96 includes grille 98 arranged above and running parallel to projection portion 52. Grille 98 includes a pair of belt-shaped grille wings **100*a* and 100*b*, which are connected rotatably to each other by axis member 102. Boss parts 104*a* and 104*b* are formed to extend from the sides of grille wings 100*a* and 100*b*, respectively. Boss parts 104*a* and 104*b* are inserted slidably into slits 106*a* and 106*b* which are formed in an end wall of projection portion 52. The directions of slits 106*a* and 106*b* are horizontal and run parallel to a connecting line between inlet portions 68**.

One end of axis member 102 is projected over an end surface of grille wing **100*a* and 100*b*. Projecting portion 102*a* of axis member 102 is connected rotatably with an eccentric portion of the disc surface of disc cam 108. The center portion of disc cam 108 is connected rotatably with an output axis of a louver drive motor 110 which is supported inside of projection portion 52. By using the above-disclosed structure, grille wings 100*a* and 100*b* are positioned in the horizontal direction (see FIG. 6) if projecting portion 102*a* of axis member 102 is driven to its lowermost position on cam 108 by louver drive motor 110. In this case, grille wings 100*a* and 100*b* are disposed parallel to the inner bottom surface of projection portion 52. In this condition, the air circulating through indoor heat exchangers 80 and 82 is directed through nozzles 70 and 72, and along radiation surfaces 66 toward inlet portions 68 (that is, along the lateral direction). Alternatively, if projecting portion 102*a* of axis member 102 is driven to its uppermost position on cam 108 by louver drive motor 110, grille wings 100*a* and 100*b* are shaped like a reverse character V from a side view. In this case, the air circulating through indoor heat exchangers 80 and 82 is blown downward through nozzles 70 and 72 towards the center portion of room 32**.

Figure 8:
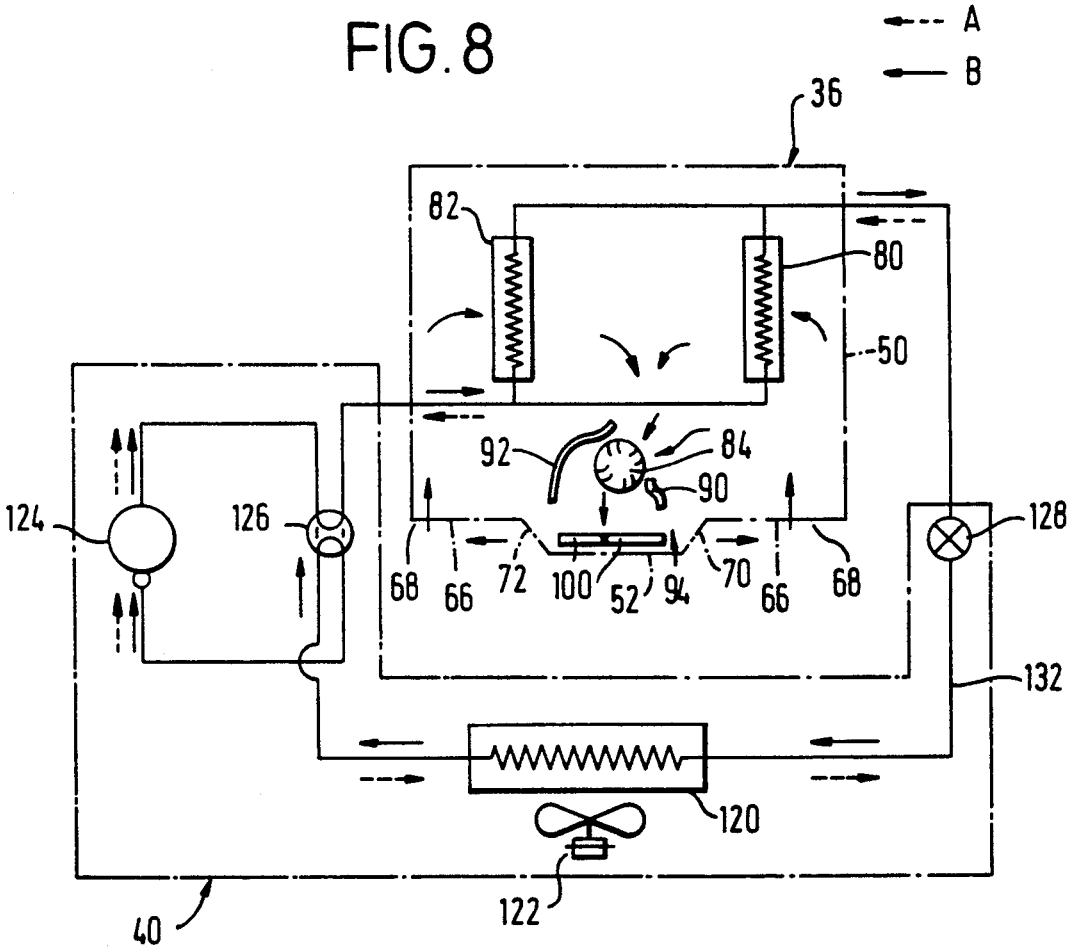
FIG. 8 is a block diagram of the air conditioning system shown in FIG. 1.

The details of outdoor unit 40 are described below with reference to FIGS. 1 and 8. FIG. 8 is a block diagram of the air conditioning system shown in FIG. 1. Outdoor unit 40 includes outdoor heat exchanger 120, outdoor fan 122, compressor 124, four-way (reversible) valve 126, and expansion valve 128 (i.e., a pressure reducing apparatus) disposed in container 130. Four-way valve 126, a parallel circuit including indoor heat exchangers 80 and 82 of indoor unit 36, expansion valve 128, and outdoor heat exchanger 120 are connected in series to compressor 124 with, and refrigerant is communicated through, refrigerant communication tube 132. The above-disclosed structure provides a reversible-mode air conditioning system having a refrigerating and heating cycle.

Figure 9:
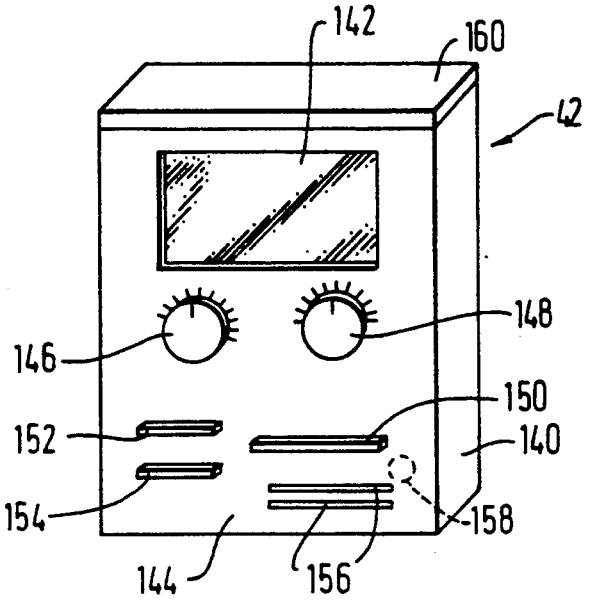
FIG. 9 is a perspective view of the remote controller shown in FIG. 1.

Remote controller 42 is disclosed below in detail with respect to FIGS. 1 and 9. FIG. 9 is a perspective view of remote controller 42. Referring to FIGS. 1 and 9, control box 134 which is disposed inside indoor unit 36 and operated by remote controller 42, is described in more detail at a later point. Remote controller 42 includes container 140. Display 142, which may be for example a liquid crystal display, is fixedly attached to an upper portion of front panel 144 of container 140. Control knobs 146 and 148 are mounted side by side at the middle portion of front panel 144. Control knob 146 regulates the temperature setting at which the air conditioning system switches between radiation and convection operations. Knob 148 is utilized to input a predetermined temperature to the system. The operation of both knobs is disclosed in more detail below. Mounted on the lower portion of front panel 144 is on/off power switch 150, cooling switch 152 and heating switch 154 for selecting a cooling or heating mode of operation, respectively. Also, ventilation slots 156 are formed on the lower portion of front panel 144 in container 140 so that contact is maintained between the air in room 32 with temperature sensor 158 disposed in container 140. Attached to the upper portion of container 140 is transmitter 160, which may be for example an infrared ray transmitter, and which transmits signals including control information to be received by control box 134 in indoor unit 36.

Figure 10:
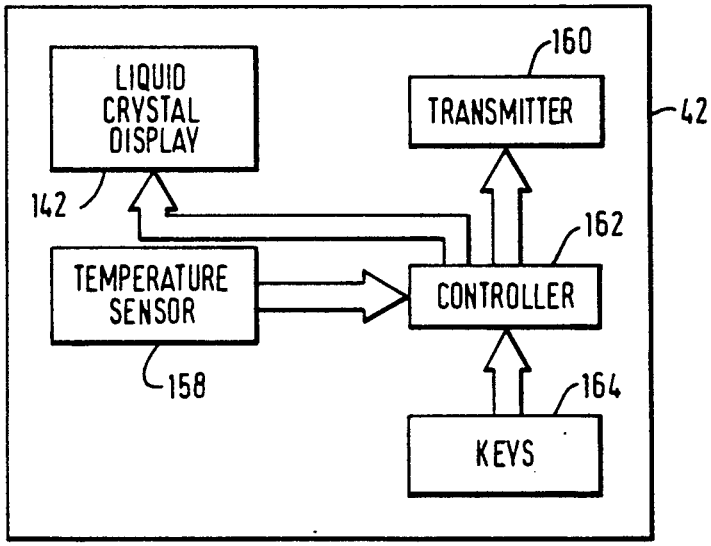
FIG. 10 is a block diagram of the remote controller shown in FIG. 9.

The control circuits included in container 140 are described below with respect to FIG. 10, which is a block diagram of remote controller 42. Controller 162 is connected to liquid crystal display 142, temperature sensor 158, transmitter 160 and keys (i.e., knobs and switches) 164, which include inputs from temperature knobs 146 and 148 and switches 150, 152 and 154. Controller 162, which may include a known process controller or microcomputer, directs transmitter 160 to transmit the switching and temperature information from knobs 146 and 148, the cooling or heating selection from switches 152 and 154, and the power on/off selection from switch 150 (all provided from the group of keys 164), and the air temperature of room 32 as detected by temperature sensor 158. Except for the power on/off information, the above-described data is transmitted only when the power on/off switch is on. Liquid crystal display 142 selectively displays the above-described information with alphanumeric characters.

The signal transmitted from transmitter 160 is received by receiver 166, which is attached to a lower surface of container 50 of indoor unit 36 (see FIG. 1). The received signal at receiver 166 is provided as an input to control box 134 in indoor unit 36. Control box 134 controls the operations of indoor unit 36 and outdoor unit 40 in response to the data included in the received input signal.

Figure 11:
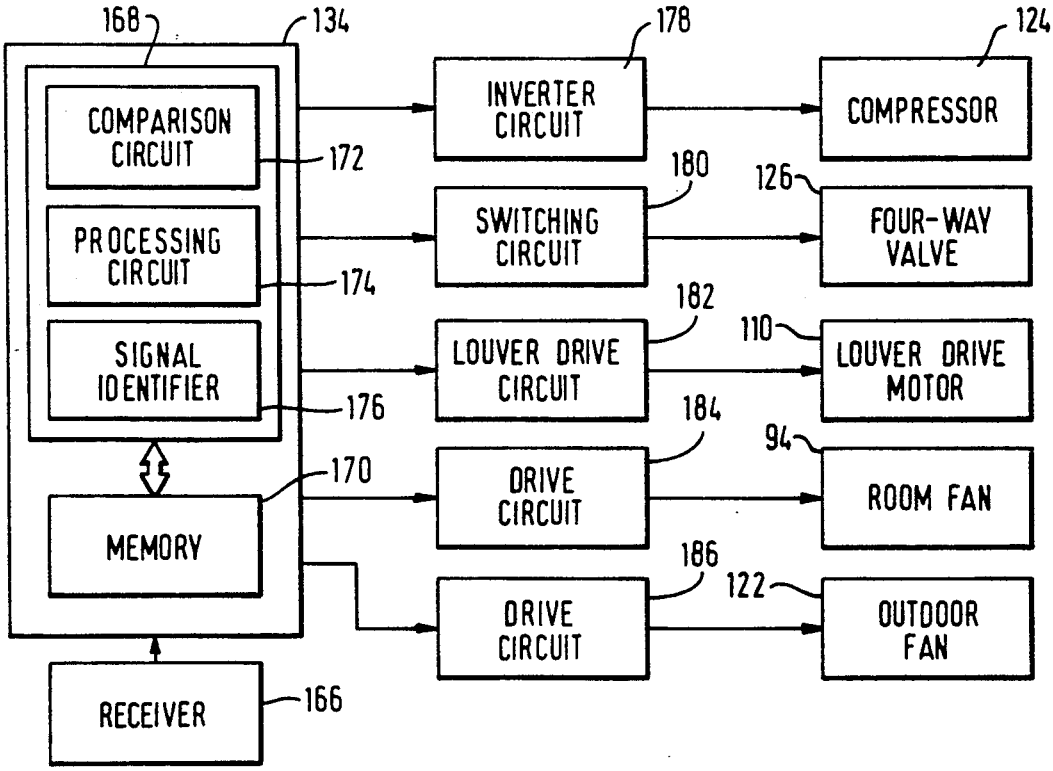
FIG. 11 is a block diagram of the control subsystem of the air conditioning system shown in FIG. 1.

The details of control box 134 are now described with respect to FIG. 11, which is a block diagram of the control subsystem for the air conditioning system shown in FIG. 1. Referring to FIGS. 1 and 11, control box 134 includes CPU (central processing unit) 168 and memory 170. Memory 170 may include random access memory (RAM) area. CPU 168 includes comparison circuit 172, processing circuit 174 and signal identifier 176. Memory 170 stores the information about room temperature, the temperature settings of knobs 146 and 148, and so on.

CPU 168 is connected to indoor unit 36 and outdoor unit 40. That is, CPU 168 is connected to an electric drive motor (not shown) of compressor 124 through inverter circuit 178, to four-way valve 126 through switching circuit 180, to louver drive motor 110 through louver drive circuit 182, to room fan 94 through drive circuit 184, and to outdoor fan 122 through drive circuit 186.

CPU 168 controls each component described directly above in response to the information signal received from transmitter 160 in remote controller 42. Thus, CPU 168 controls the air conditioning system's cycling by switching between the cooling and heating modes in response to the selection signal from transmitter 160. Additionally, CPU 168 controls the operation of compressor 124 in both the heating and cooling modes, by initially operating compressor 124 at a high speed and subsequently operating it at a variable speed by changing the frequency of the input power, in response to the difference between the designated (set) temperature selected by knob 148 and the room temperature detected by temperature sensor 158. Compressor 124 is stopped if the temperature detected by temperature sensor 158 equals the designated temperature.

CPU 168 controls switching of the air conditioning system between the radiation and convection modes of operation, in response to the switching temperature input from knob 146. That is, during a heating cycle of operation, convection heating is selected if the temperature detected by sensor 158 is lower than the switching temperature determined by knob 146. Radiation heating is selected if the temperature detected by sensor 158 is higher than the switching temperature determined by knob 146. Conversely, during a cooling cycle of operation, convection (or radiation) cooling is selected if the temperature detected by the sensor 158 is higher (or lower) than the switching temperature. CPU 168 also controls the rotation of louver drive motor 110 so that grille wings 100*a* and 100*b* are positioned either downward or laterally (horizontally) for convection or radiation air conditioning, respectively. By operating as described above in accordance with the present invention, either cooled or heated air may be directed toward the center area of room 32 if the air conditioning load is large or the cooling or heating operation has just started.

Figure 12:
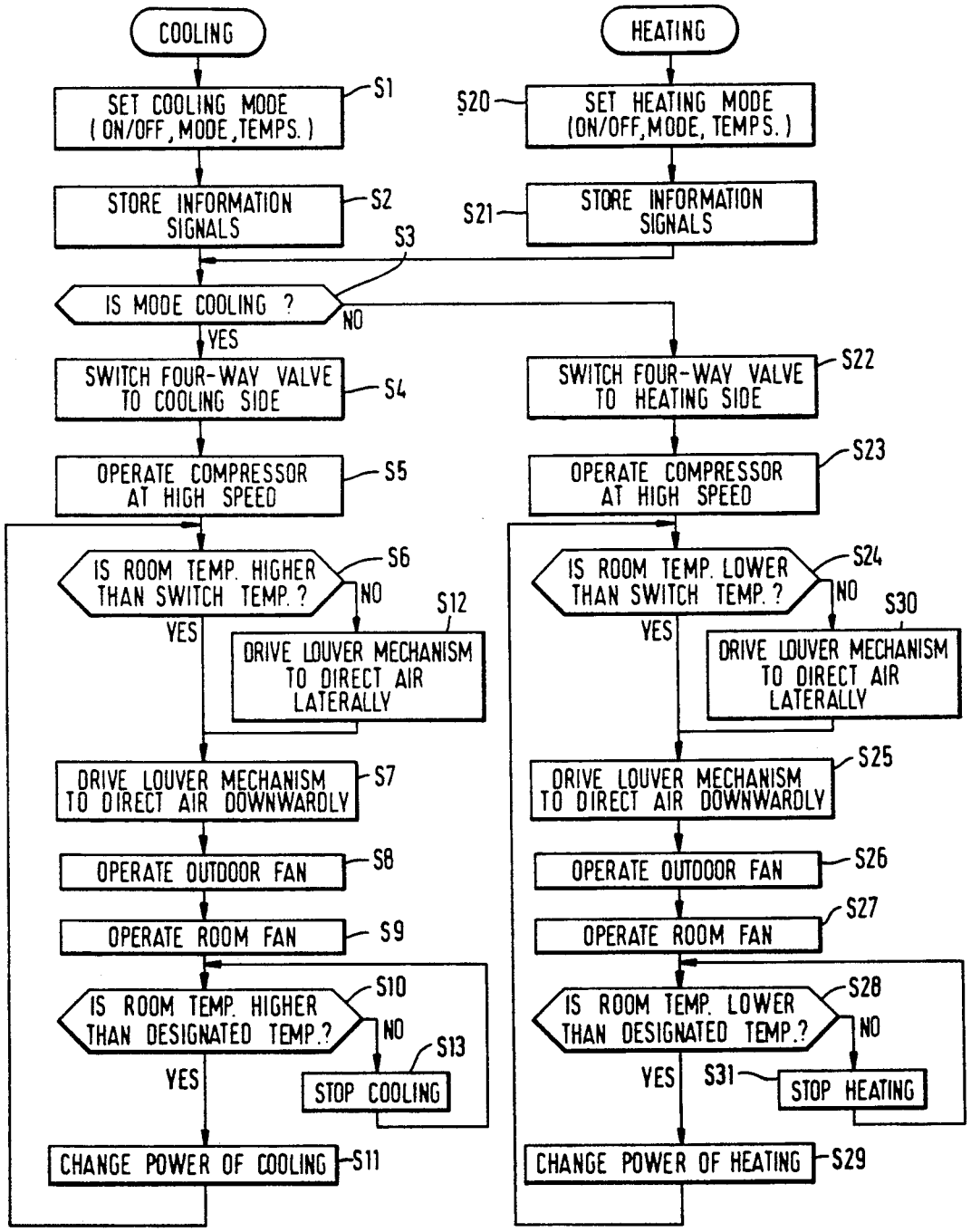
FIG. 12 is a flow chart illustrating the cooling and heating operations of the air conditioning system shown in FIG. 1.

FIG. 12 is a flow chart that illustrates the cooling and heating operation of the air conditioning system disclosed with respect to FIGS. 1–11. Referring to FIG. 12, if the air conditioning system is desired to be operated in the cooling mode, an operator (not shown) first sets on/off switch 150 to the ON position. Next, cooling switch 152 is pushed to activate the cooling mode of operation. Knob 146 is set to a desired switching temperature, and knob 148 is set to its designated temperature (step S1). The above-described cooling mode command signal and the temperature settings from knobs 146 and 148 are transmitted from transmitter 160 to receiver 166, where these signals are then coupled to CPU 168. Under the control of CPU 168, these command and data signals are stored in memory 170 (step S2). CPU 168 then determines whether the command for cooling is present or not (step S3). In this case, the command signal for the cooling mode is present. Consequently, four-way valve 126 is switched to the cooling cycle position (step S4). As discussed earlier, the electric drive motor of compressor 124 is operated at high speed for the initial startup to provide maximum cooling (step S5). Thus, referring also to FIG. 8, during the cooling mode of operation, the refrigerant is compressed in compressor 124 and circulated through the system from compressor 124 to four-way valve 126, outdoor heat exchanger 120, expansion valve 128 and then to indoor heat exchangers 80 and 82 in the direction designated by the dashed arrows (A). Meanwhile, the room air temperature detected by temperature sensor 158 in remote controller 42 is transmitted by transmitter 160 to receiver 166 and coupled to CPU 168. CPU 168 compares the received room temperature with the received switching temperature selected by knob 146 (step S6). At the onset of cooling, the temperature sensed in room 32 is relatively high and, consequently, the air conditioning load is large. At this point, the room temperature is higher than the selected switching temperature. Consequently, CPU 168 provides a command signal to louver drive circuit 182 that causes louver drive motor 110 to position grille wings 100*a* and 100*b* in an inverted V (see FIG. 7), in order to direct the air from nozzles 70 and 72 downward into the room area (step S7). CPU 168 then provides commands to drive circuits 184 and 186 to operate outdoor fan 122 and room fan 94 (steps S8 and S9).

Figure 13:
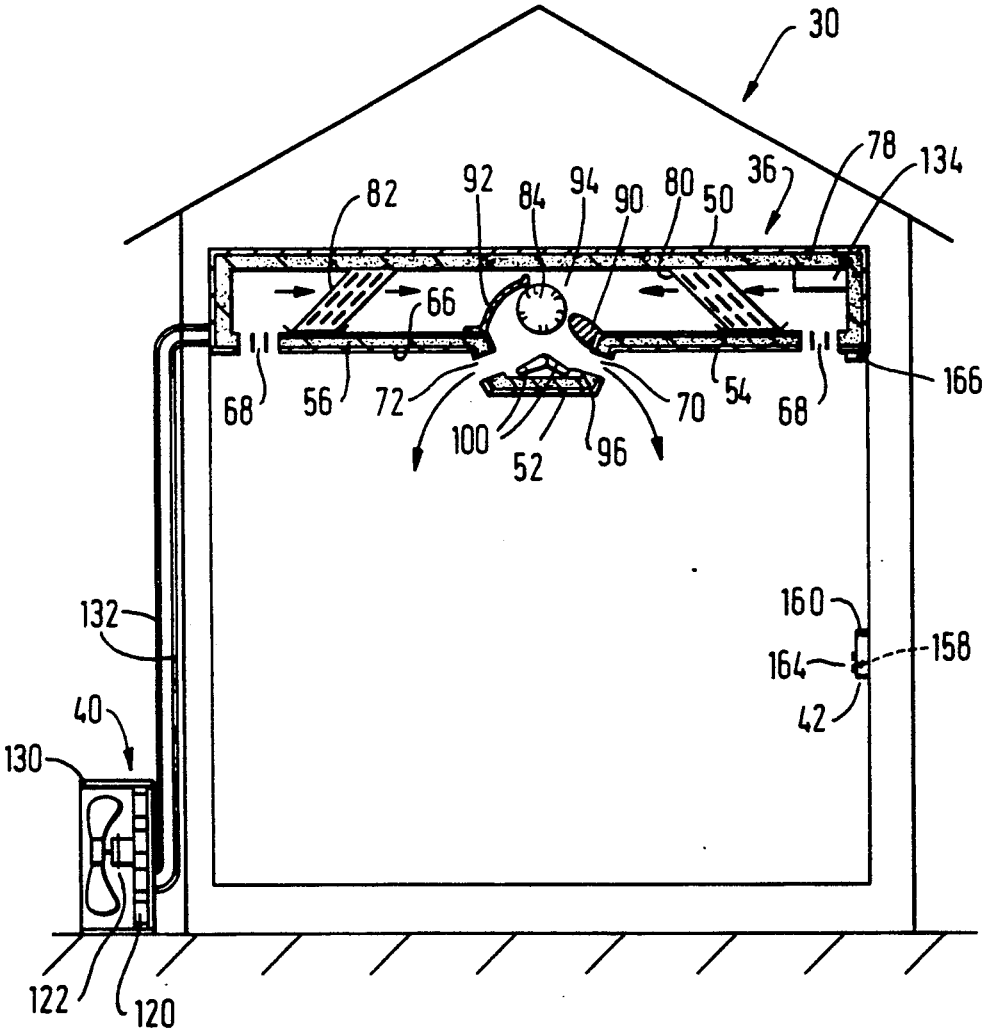
FIG. 13 is a cross sectional view of the cooling and heating by convection of the house shown in FIG. 1.

The air in room 32 is pulled in through inlet portions 68 and directed to air circulation paths 74 and 76. In the cooling mode, the air moving through air circulation paths 74 and 76 is heat-exchanged and cooled by indoor heat exchangers 80 and 82. The columns of cooled air moving indoor heat exchangers 80 and 82 are blown diagonally-downward into the room area from nozzles 70 and 72 (e.g., see FIG. 13). In this manner, the residential areas are directly cooled by the use of convection cooling. Consequently, the residential area is cooled rapidly at the onset of the cooling cycle.

Next, the sensed room temperature is compared by CPU 168 with the designated temperature set by knob 148 (step S10). If the sensed room temperature is higher than the designated temperature (i.e., if the answer to step S10 is yes), then the cooling mode of operation is continued. However, the amount of cooling (i.e., the cooling output of compressor 124) may be continuously varied in response to the difference between the sensed room temperature and the designated temperature, by changing the operating speed of compressor 124 (step S11). More precisely, the power frequency of compressor 124 may be changed so that the cooling output of compressor 124 is proportional to the magnitude of the difference between the sensed room temperature and the designated temperature. CPU 168 again performs the operation of step S6.

Figure 14:
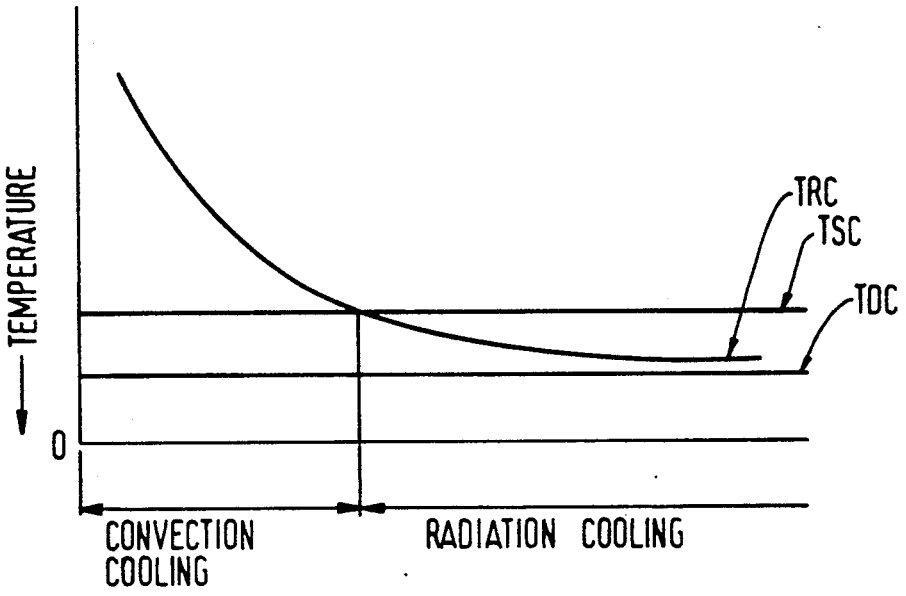
FIG. 14 illustrates the change in room temperature while cooling the house shown in FIG. 1.

With the air conditioning system operating in the convection cooling mode, the room temperature TRC decreases as shown in FIG. 14. If the room temperature decreases to the switching temperature TSC, the air conditioning load is considered to be small. For step S6 in this case, if the room temperature is determined by CPU 168 to be equal to or less than the switching temperature (i.e., the answer to step S6 is no), then step S12 is performed next. Thus, CPU 168 provides a command signal for louver drive circuit 182 to drive louver drive motor 110 and position grille wings 100*a* and 100*b* laterally or flat (see FIG. 6), in order to direct the cooled air from nozzles 70 and 72 (step S12). Consequently, the cool air columns from nozzles 70 and 72 are directed laterally along radiation surface 66 to inlet portions 68 (see FIG. 1). These laterally directed columns of cool air from nozzles 70 and 72 are heat-exchanged with the air contacting radiation surface 66, so that the cooled columns of air act to cool radiation surface 66. Consequently, dew or water condensation does not form on radiation surface 66 because radiation surface 66 is cooled indirectly by the moving columns of cooled air instead of being cooled or heat-exchanged directly by circulating the refrigerant next to the radiation surface. Specifically, the temperature of radiation surface 66 is higher than that of the moving columns of cooled air, because radiation surface 66 is cooled by the moving columns of cooled air. Consequently, dew or water condensation does not form on radiation surface 66 because the dew point temperature is lower than the temperature of the surrounding cool air. For example, if the temperature of the cooled column of air is 15° C., the temperature at radiation surface 66 will be higher than 15° C. because a heat exchange has occurred between the air column and the radiation surface. In this case, the relative humidity of the cooled air in contact with radiation surface 66 is generally about 85%, and the dew point temperature is about 12.5° C. Thus, dew or water condensation will not occur. Additionally, the heat conduction ratios for plates 54 and 56 are designed to be low, in order to prevent the formation of dew or water condensation. Moreover, in the event dew or water condensation happens to form because of a mechanical problem in the air conditioning system, the resulting moisture is retained or absorbed by the group of hair-like projections 64 that are implanted on radiation surface 66. Consequently, the floor in room area 32 will not get wet from droplets of water dripping from radiation surface 66. Most importantly, however, the residential areas are radiation cooled utilizing radiation surface 66 in accordance with the present invention (see, e.g., FIG. 16). Consequently, this invention provides an improved structure for radiation cooling a room or similar compartment that eliminates uncomfortable drafts typically experienced by residents using conventional air conditioning systems.

After performing step S12, steps S7 and S8 are performed as described earlier. Next, steps S9 and S10 are again performed. However, at this point for step S10, if the sensed room temperature is equal to or less than the designated temperature (i.e., the answer to step S10 is no), the next step performed is step S13. For step S13, CPU 168 provides a command signal to stop the operation of compressor 124. Then, step S10 is performed again.

At this point, if the air conditioning load responsive to the temperature in room 32 were to increase rapidly by, for example, opening windows in room 32 or the entrance of additional people into the cooled area, the expected increase in room temperature may be prevented by changing the cooling mode from radiation cooling to convection cooling (i.e., by performing steps S6 and S7). Also, an operator need only set knob 148 to a lower temperature if additional cooling is needed or desired (steps S6 and S7 would respond to this new setting).

The heating mode of operation is now described in accordance with the present invention. Referring to FIGS. 9 and 12, in order to operate the present air conditioning system in the heating mode, an operator (not shown) presses on/off switch 150 to the ON position. Then heating switch 154 is pressed. As described earlier, knobs 146 and 148 are set to their respective switching temperature and designated temperature (see step S20 in FIG. 12). Similar to the cooling mode of operation, the data or information signals representing the heating mode command and the temperature settings from knobs 146 and 148 are transmitted from transmitter 160 to receiver 166 and coupled to CPU 168. These data or information signals are stored in memory 170 for subsequent processing by CPU 168 (step S21). Then CPU 168 determines whether or not the cooling command is present (step S3). In the heating mode of operation, the answer to step S3 is no. Consequently, the next steps to be performed are steps S22 and S23. For step S22, CPU 168 provides a command signal to switch four-way valve 126 to the heating position. At the onset of heating, the electric drive motor (not shown) for compressor 124 is operated at high speed (step S23). Thus, referring to FIG. 8 for the heating mode of operation, the refrigerant is compressed in compressor 124 and circulated from compressor 124 to four-way valve 126, indoor heat exchangers 80 and 82, expansion valve 128, and outdoor heat exchanger 120 in the direction shown by the solid arrows (B). Meanwhile, the room air temperature detected or sensed by temperature sensor 158 in remote controller 42 is transmitted, received and coupled to CPU 168 as described earlier for cooling, but with heating switch 154 now in the ON position. Next, CPU 168 compares the sensed room temperature with the switching temperature selected or set by knob 146 (step S24). At the onset of heating, the sensed temperature of room 32 is very low, so the air conditioning load is large at this point. Also, the sensed room temperature is lower than the switching temperature. Thus, the next step to be performed is step S25. In performing the operation of step S25, CPU 168 provides an output command that is coupled to louver drive circuit 182, which causes grille wings 100*a* and 100*b* of louver mechanism 96 to be positioned diagonally-downward (as shown in FIG. 7) by louver drive motor 110. Thus, the heated columns of air from nozzles 70 and 72 are directed downward into the center of room area 32. Then CPU 168 issues command signals that are coupled to drive circuits 184 and 186 that, in turn, cause the operation of outdoor fan 122 and room fan 94 (steps S26 and S27).

The air in room 32 is pulled in through from inlet portions 68 and circulated through air circulation routes 74 and 76. The columns of air that are circulated through air circulation routes 74 and 76 are heat exchanged so as to be heated by indoor heat exchangers 80 and 82. The heated columns of air flowing through indoor heat exchangers 80 and 82 are directed diagonally-downward from nozzles 70 and 72 into the center of the room. This operation provides convection heating. Consequently, at the onset of the heating mode of operation, the residential area is heated rapidly by convection heating (e.g., see FIG. 13).

The next step to be performed is step S28. In performing the operation of step S28, CPU 168 compares the current, sensed room temperature with the designated temperature set by knob 148 on remote controller 42. If the sensed room temperature is lower than the designated temperature (i.e., the answer to step S28 is yes), then the heating mode of operation is continued. However, the amount of heat produced by the system (i.e., heat power output) may be varied in response to the difference between the sensed room temperature and the designated temperature, by varying the operational speed of compressor 124 (step S29). Specifically, the input power frequency of compressor 124 may be varied.

Figure 15:
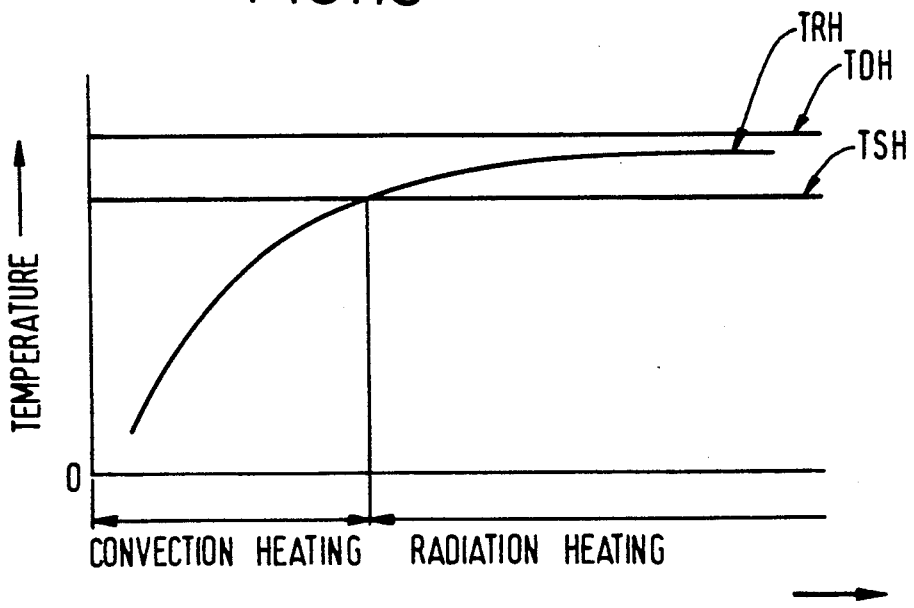
FIG. 15 illustrates the change in room temperature while heating the house shown in FIG. 1.

The next operation to be performed is step S24 in FIG. 12. With convection heating, the temperature TRH in room area 32 increases as shown in FIG. 15. Referring to FIG. 15, if the room temperature TRH is increased to at least the value of the switching temperature TSH, the air conditioning load for the room is considered small. Thus, returning to step S24 in the next iterative loop in FIG. 12, if the sensed room temperature TRH is equal to or greater than the switching temperature TSH (i.e., the answer to step S24 is no), the next step to be performed is step S30. In performing the operation of step S30, CPU 168 provides a command signal to louver drive circuit 182 to drive louver drive motor 110 so as to position grille wings 100*a* and 100*b* of louver mechanism 96 in the lateral direction (flat as shown in FIG. 6). Consequently, the heated columns of air from nozzles 70 and 72 are directed laterally along radiation surface 66 to inlet portions 68 (see FIG. 1). Radiation surface 66 is heated by the warm air from nozzles 70 and 72. Thus, the residential area is heated by radiation heating in accordance with the present invention, and the residents are not subjected to uncomfortable drafts of air.

After step S30 is completed, the next steps to be performed in sequence are steps S25 through S28. The operations in these steps are similar to those described above with respect to the cooling mode of operation. However, in performing step S28, if CPU 168 determines that the sensed room temperature TRH is equal to or greater than the designated temperature TDH (i.e., the answer to step S28 is no), then the next step to be performed is step S31. In this event, heating is discontinued by stopping the compressor drive motor. After step S31 is performed, CPU 168 then reperforms step S28, and so on. If the air conditioning load for heating room 32 is increased rapidly by, for example, opening windows to the heated area, the possibility of a significant decrease in room temperature may be eliminated by changing from the radiation heating mode to the convection heating mode of operation (by performing steps S24 and S25). A similar effect may be achieved so as to rapidly heat the room, by adjusting knob 148 to a higher temperature.

Figure 16:
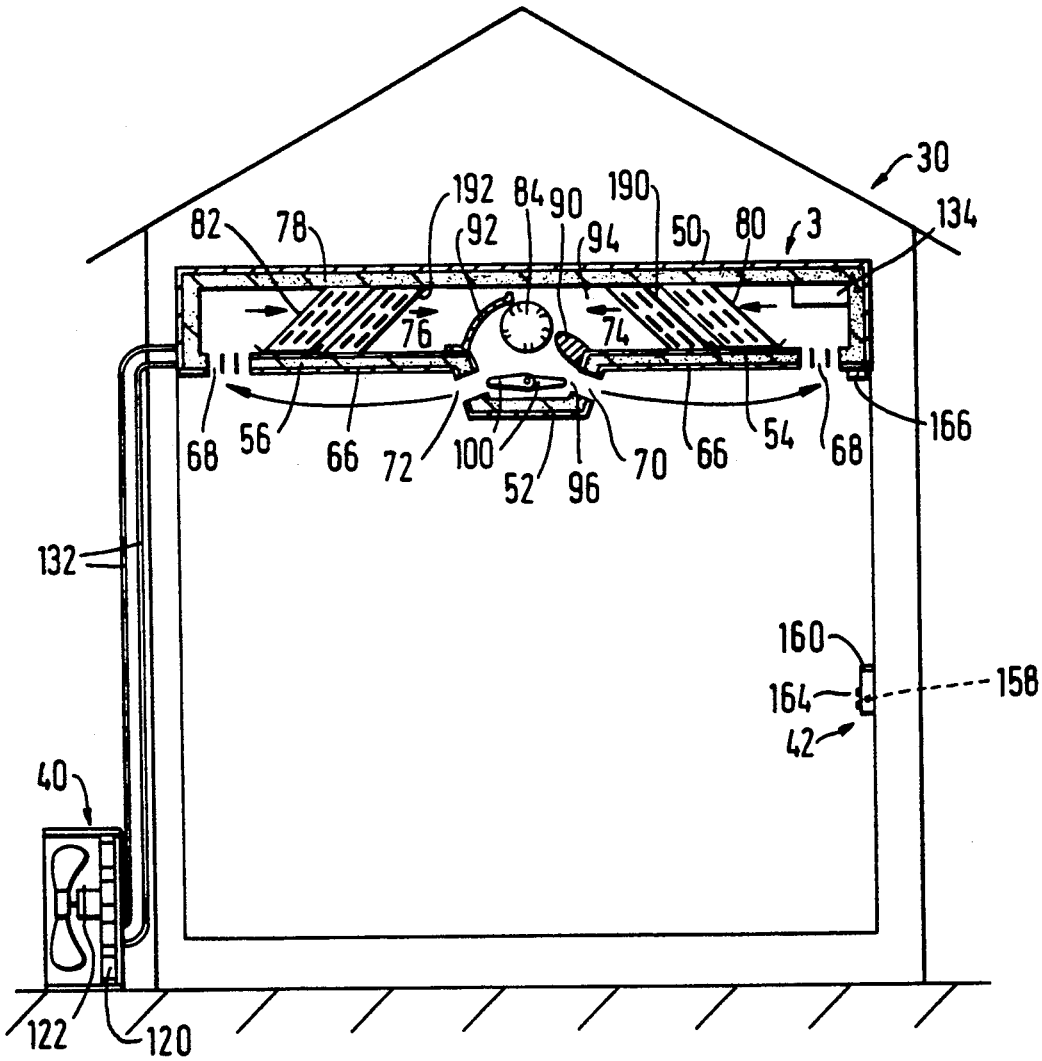
FIG. 16 is a cross sectional view of a house and an air conditioning system in accordance with a second embodiment of the present invention.

FIG. 16 is a cross sectional view of a second embodiment of the present invention. This second embodiment comprises the structure disclosed above in accordance with the first embodiment, and an additional structure of a dehumidifying apparatus. In FIGS. 16 through 21, like numerals refer to like elements and, in the interest of convenience, the detailed descriptions of the like elements are not repeated.

The primary differences between the first embodiment of the present invention and this second embodiment are that a second set of heat exchangers 190 and 192 for auxiliary reheating are fixedly attached to container 50 and supported within circulation routes 74 and 76 between respective indoor heat exchangers 80 and 82, and room fan 94. Auxiliary heat exchangers 190 and 192 are activated during cooling when the room humidity is exceptionally high.

Figure 17:
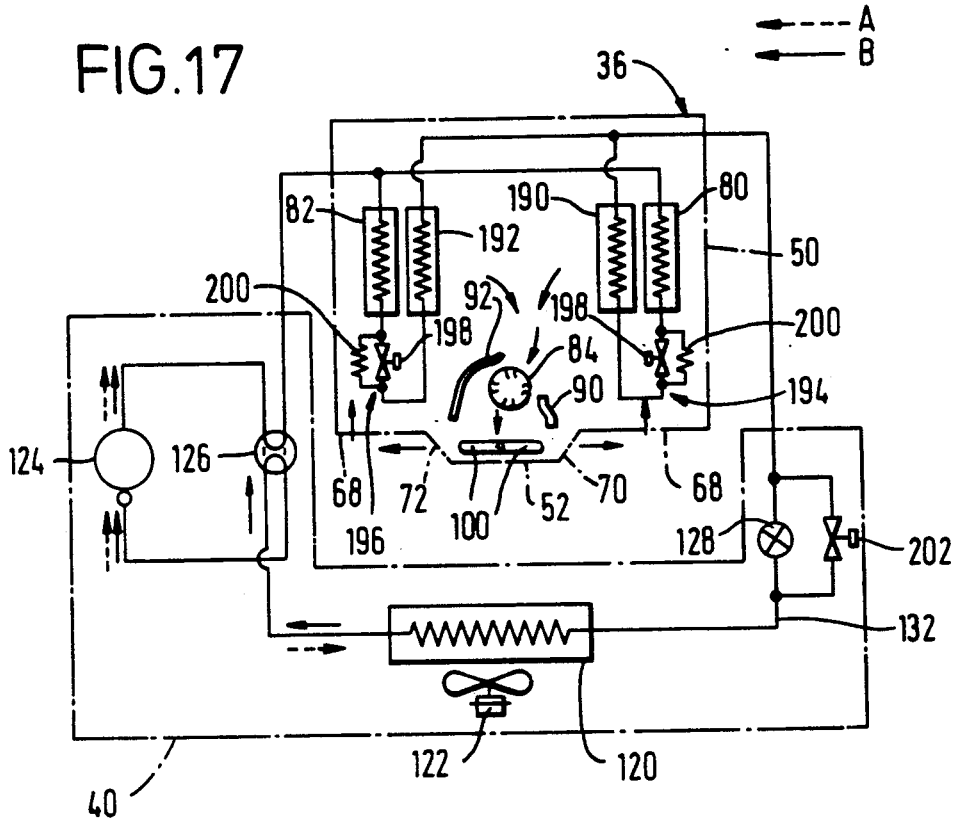
FIG. 17 is a block diagram of the air conditioning system shown in FIG. 16.
Figure 18B:
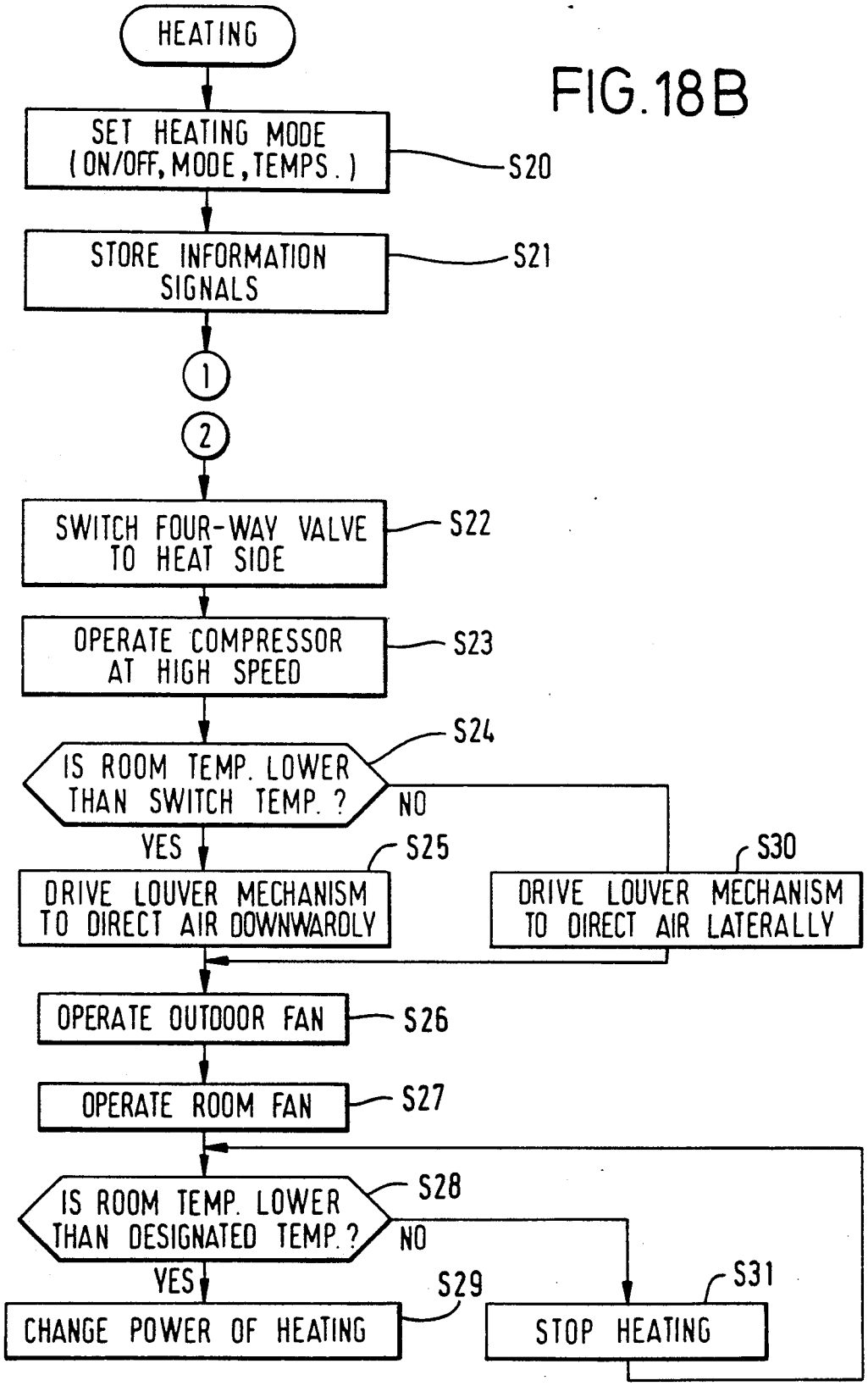
FIG. 18*b* is a flow chart illustrating the heating operation of the air conditioning system shown in FIG. 16.
Figure 18A:
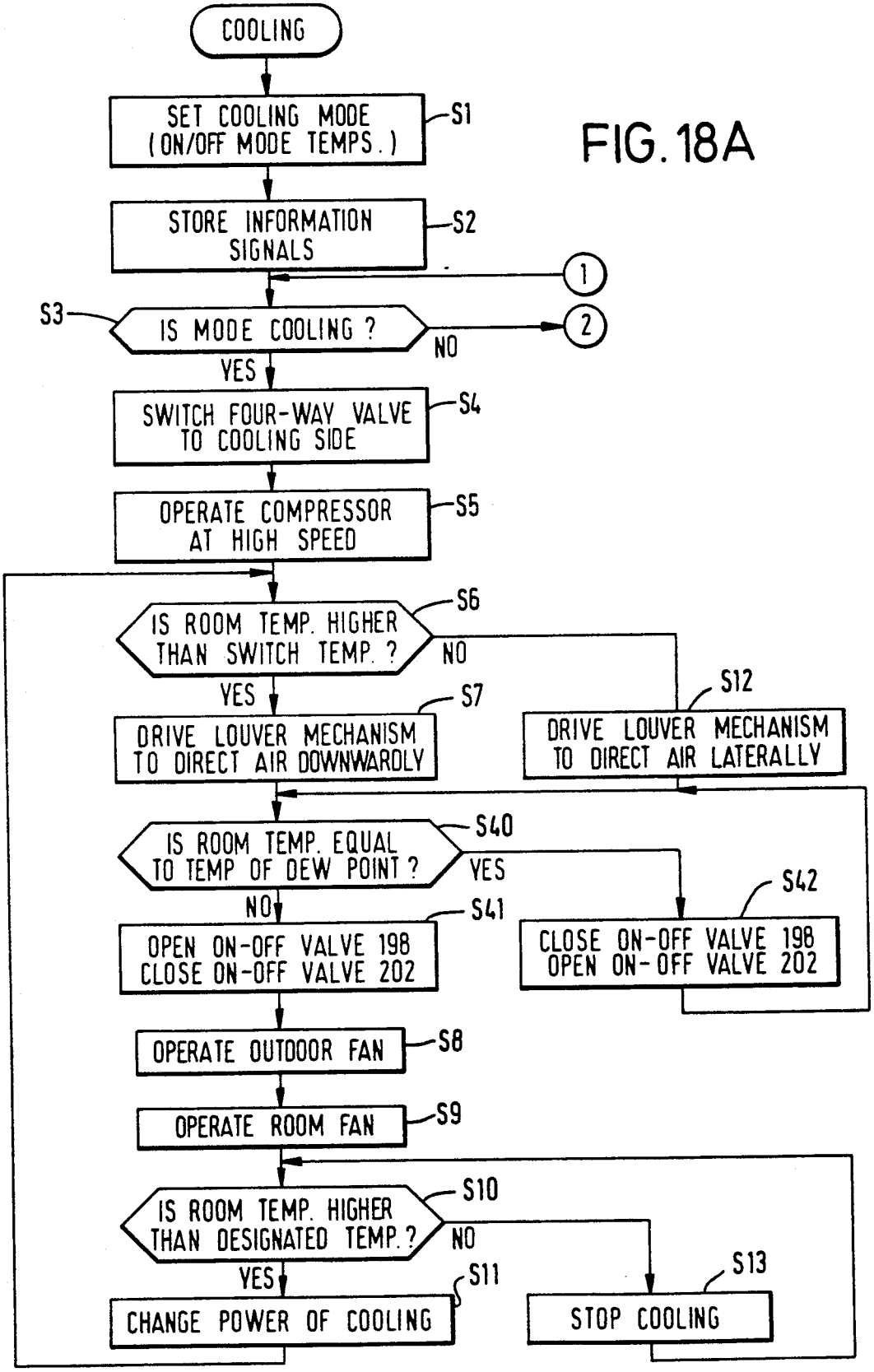
FIG. 18*a* is a flow chart illustrating the cooling operation of the air conditioning system shown in FIG. 16.

Specifically, FIG. 17 is a block diagram of the air conditioning system shown in FIG. 16, and FIG. 18 is a flow chart that illustrates the cooling and heating modes of operation of the air conditioning system shown in FIG. 17.

Referring to FIG. 17, auxiliary heat exchangers 190 and 192 are added to the elements disclosed in FIG. 2, and heat exchangers 190 and 192 are connected in series with expansion valve 128 and one side of their respective indoor heat exchangers 80 and 82. Additionally, refrigerant flow circuits 194 and 196 each includes on-off valve 198 connected in parallel with capillary tube 200, which circuits are connected between indoor heat exchangers 80 and 82 and auxiliary heat exchangers (for heating) 190 and 192, respectively. Also, on-off valve 202 is connected in parallel with expansion valve 128.

Referring to the flow chart in FIG. 18, steps S40, S41, S42 are added to the steps shown in FIG. 12. FIG. 12 is a flow chart that represents the operation of the above-disclosed first embodiment of the present invention. That is, in the cooling mode of operation, the determination of whether or not the sensed room temperature has reached the dew point temperature is made in step S40. If the answer to step S40 is no, then on-off valves 198 and 202 are opened and closed, respectively (step 41). On the other hand, if the answer to step S40 is yes (i.e., dew or water condensation may easily form), then on-off valves 198 and 202 are closed and opened, respectively (step 42). By the above-disclosed operations, auxiliary heat exchangers 190 and 192 are operated as heaters. Thus, the air columns cooled by indoor heat exchangers 80 and 82 are heated by auxiliary heat exchangers 190 and 192. Consequently, the dew point temperature is decreased and dew or water condensation is not likely to form.

After step S42 is completed, the next step to be performed is step S40. Thereafter, the loop comprising steps S42 and S40 is continued until the answer to step 40 is determined to be no. In that case, the operation continues with step S41.

Additionally, with respect to the above-disclosed second embodiment, auxiliary heat exchangers 190 and 192 may be adapted to operate as dehumidifiers. However, to so operate, a consonant structure for controlling the rotation of the room fan 94 must also be adopted. That is, the quantity of air flowing through indoor heat exchangers 80 and 82 should be decreased so that the latent heat exchange is increased by a proportional amount. This operation serves to drop the dew point temperature.

Figure 19:
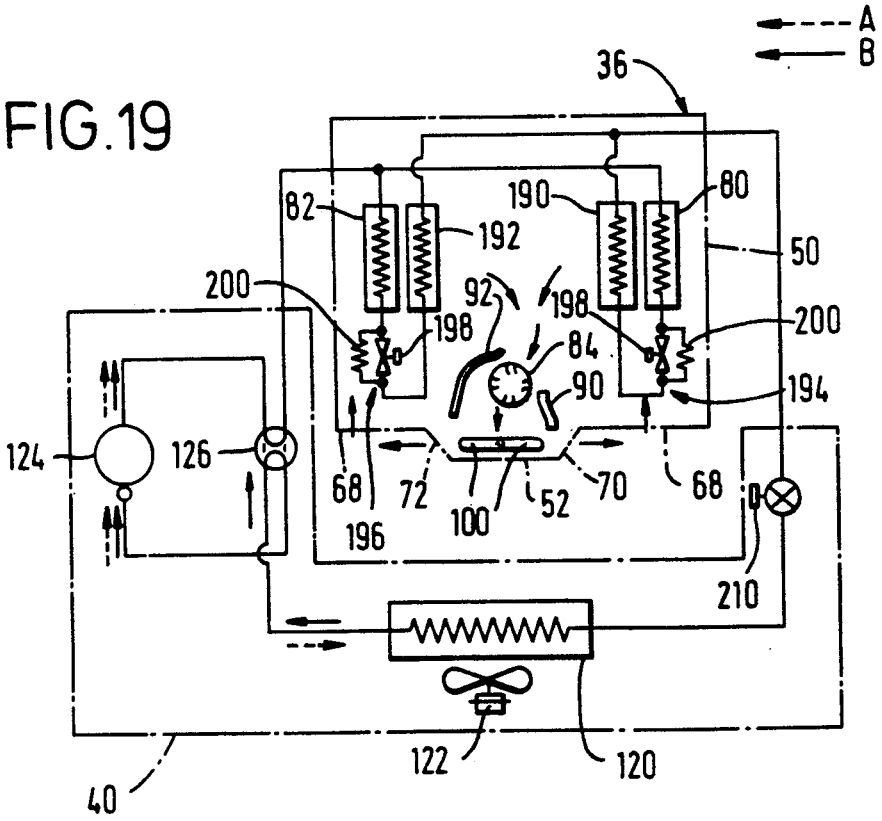
FIG. 19 is a block diagram of an air conditioning system in accordance with a third embodiment of the present invention.

FIG. 19 is a block diagram of an air conditioning system in accordance with the third embodiment of the present invention. The third embodiment utilizes electrically-controlled expansion valve 210 whose quantity of reduction is varied widely by a driving member such as an electric drive motor, instead of utilizing expansion valve 128 and on-off valve 202 as disclosed above with respect to the second embodiment shown in FIG. 17.

Figure 21:
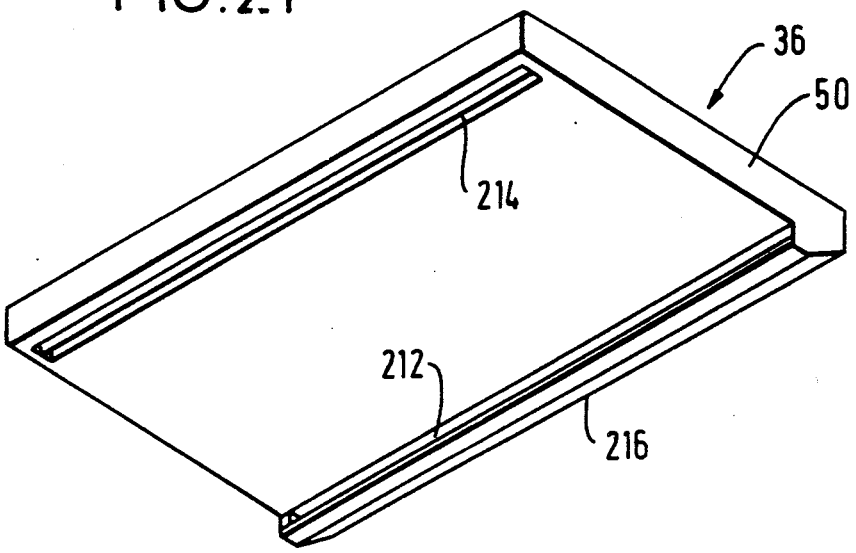
FIG. 21 is a perspective view of a radiation surface of the indoor unit shown in FIG. 20.
Figure 20:
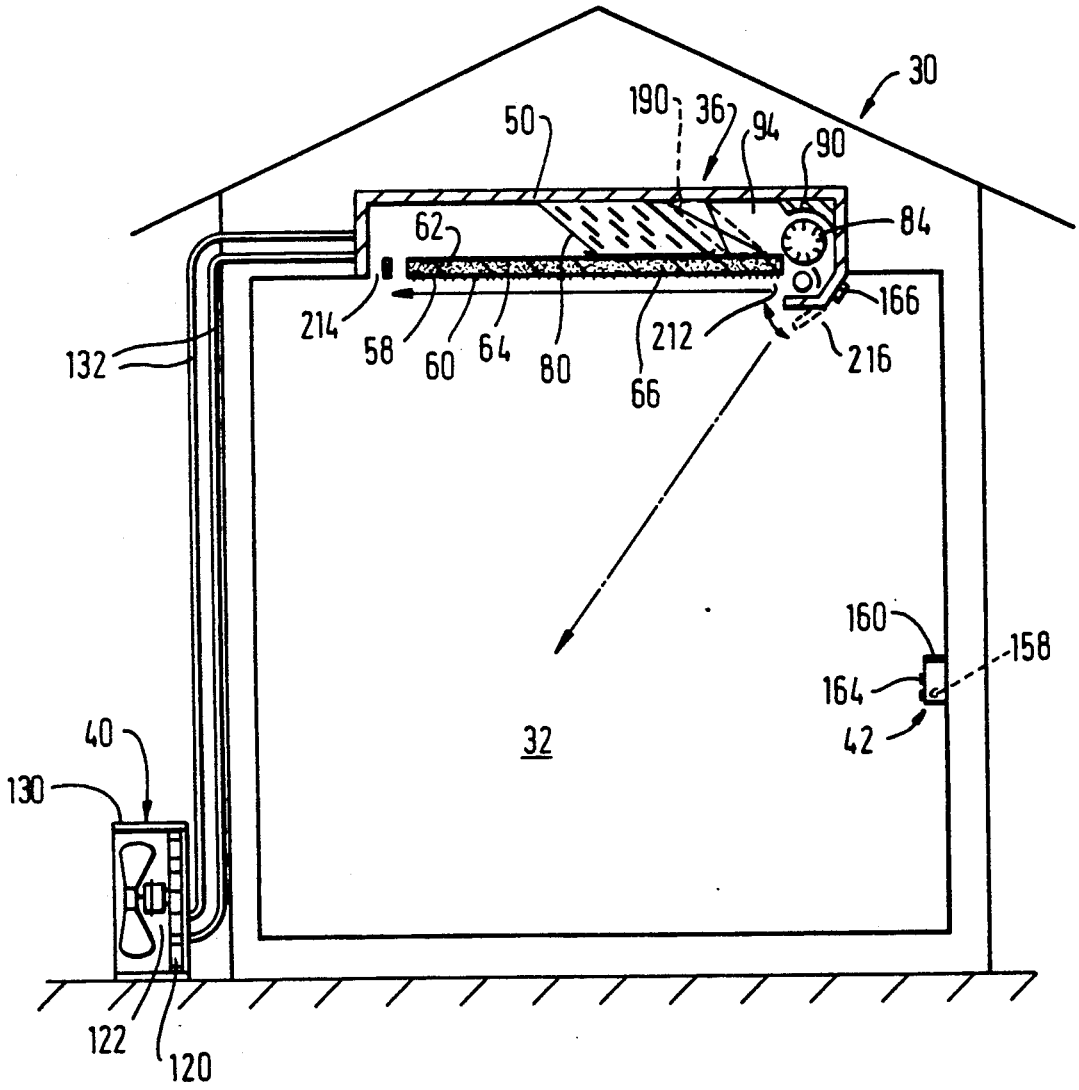
FIG. 20 is a cross sectional view of a house and an air conditioning system in accordance with a fourth embodiment of the present invention.

FIG. 20 is a cross sectional view of an air conditioning system in accordance with the fourth embodiment of the present invention. In the fourth embodiment, the cooled or heated air flowing from heat exchanger 80 in the indoor unit is directed only from one end of the lower surface of the indoor unit to cool or heat radiating surface 66, instead of directing the cooled or heated air from the center portion of the lower surface of the indoor unit. That is, the air conditioning system in the fourth embodiment has a larger radiation surface 66 than that disclosed with respect to the first or third embodiments. For example, FIG. 21 shows a perspective view from radiation surface 66 of indoor unit 36. The cooled or heated column of air is directed from a nozzle 212 located at one end of the lower surface of indoor unit 36, and along radiation surface 66. This column of air is then pulled into inlet portion 214, which is an opening located at the opposite end of the lower surface of indoor unit 36. Louver mechanism 216 is structured to operate similarly to louver mechanism 96 as positioned in inlet portion 214 and disclosed above with respect to FIG. 1. Additionally, auxiliary heat exchanger 190 as disclosed above with respect to the second embodiment may be also adapted as shown in FIG. 21 to operate as an active dehumidifier (i.e., to lower room humidity in addition to lowering the dew point temperature).

As an additional point, although the embodiments disclosed above are shown, for illustrating purposes only, as attached to the ceiling, the air conditioning system in accordance with the present invention is not intended to be so limited and also may be attached to a wall of the room.

This invention has been described in detail in connection with the preferred embodiments but that is for illustrative purposes only and the invention is not limited thereto. It will be easily understood by those skilled in the art that variations and modifications can easily be made within the scope of this invention as defined by the appended claims.

I claim:

1. In a room having an interior space to be air conditioned, an air conditioning system comprising:

a radiation member including a radiation surface facing said interior space, said surface comprising a group of hair-like projections and having water absorption and retention properties; and air supply means for directing a flow of conditioned air to the radiation surface of said radiation member.

2. An air conditioning system for use in a building comprising:

a radiation member including a radiating surface adapted to face an interior space of said building, said radiating surface comprising a material having water absorption and water retention properties;

air supply means for supplying a flow of conditioned air to the radiation surface of said radiation member; and directing means for controlling the direction of flow from said air supply means so as to selectively direct such flow with respect to the radiation surface of said radiation member.

3. The air conditioning system according to claim 2, wherein said radiation member is adapted to be attached to a ceiling of said interior space.

4. The air conditioning system according to claim 2, wherein said air supply means includes:

a container having a circulation space therein;

an inlet portion formed on a surface of said container and facing said interior space;

nozzle means formed on the surface of said container for directing air toward said inlet portion;

conditioning means, positioned in said circulating space and between said nozzle means and said inlet portion, for heating or cooling circulating air; and a ventilation fan.

5. The air conditioning system according to claim 4, wherein said conditioning means comprises a heat exchanger in a heat pump.

6. The air conditioning system according to claim 5 and further comprising auxiliary heater means disposed adjacent said heat exchanger for heating the air cooled by said heat exchanger.

7. The air conditioning system according to claim 6, wherein said auxiliary heater means heats the air cooled by said heat exchanger when the humidity of the air in said interior space exceeds a predetermined value.

8. The air conditioning system according to claim 2, wherein the radiation surface portion of said radiation member comprises a group of hair-like projections.

9. The air conditioning system according to claim 2, wherein said directing means controls the direction of flow along the radiation surface in a radiation mode of air conditioning and away from said surface in a convection mode of air conditioning.

10. The air conditioning system according to claim 2, wherein said directing means controls the direction of flow in response to the temperature of said interior space.

11. The air conditioning system according to claim 2, wherein said directing means controls the direction of flow in response to the air conditioning load.

12. An air conditioning system for use in a building comprising:

a radiation member including a radiation surface adapted to face an interior space of said building;

air supply means for supplying a flow of conditioned air to the radiation surface of said radiation member;

louver means for directing said conditioned air either along or away from said radiation surface; and louver control means for positioning said louver means such that said conditioned air is directed toward the center portion of said interior space when the air conditioning load exceeds a predetermined value.

13. The air conditioning system according to claim 12, wherein said conditioned air is directed toward the center portion of said interior space at the onset of a cooling mode of operation.

14. The air conditioning system according to claim 12, wherein the radiation surface of said radiation member comprises a material having water absorption and water retention properties.

15. The air conditioning system according to claim 12, further comprising a louver control means for positioning said louver means such that said conditioned air is directed along said radiation surface when the air conditioning load drops below a predetermined value.

16. The air conditioning system according to claim 12, further comprising a louver control means for positioning said louver means such that said conditioned air is directed toward the center portion of said interior space at the onset of a heating mode of operation.

17. An air conditioning system for use in a building comprising:

a radiation member including a radiation surface adapted to face an interior space of said building;

an air supply means for directing a flow of conditioned air to the radiation surface of said radiation member;

a container having a circulation space therein;

an inlet portion formed on a surface of said container and facing said interior space;

nozzle means formed on the surface of said container for directing air toward said inlet portion;

conditioning means, positioned in said circulating space and between said nozzle means and said inlet portion, for conditioning circulating air;

a ventilation fan; and a louver means for selectively directing said air directed toward said inlet portion either along or away from said radiation surface.

18. The air conditioning system according to claim 17, wherein a control means positions said louver means such that said air is directed toward the center portion of said interior space when the air conditioning load exceeds a predetermined value.

19. An air conditioning system for use in a building comprising:

a container having a circulation space therein;

a radiation member having a first and second surface, wherein said first surface is adapted to face an interior space of said building and said second surface faces said circulation space;

air supply means for directing a flow of conditioned air from said circulation space to said first surface; and directing means for controlling the direction of air flow from said air supply means so as to selectively direct such air flow with respect to said first surface.

* * * * *